United States Patent [19]

Lambert, Jr.

[11] Patent Number: 4,948,605

[45] Date of Patent: Aug. 14, 1990

[54] FROZEN FOOD COVER/CONTAINER ASSEMBLY FOR RECONSTITUTING THE FROZEN FOOD

[75] Inventor: Ralph A. Lambert, Jr., Gettysburg, Pa.

[73] Assignee: Hanover Brands, Incorporated, Hanover, Pa.

[21] Appl. No.: 169,042

[22] Filed: Mar. 16, 1988

[51] Int. Cl.[5] ..... B65D 81/34; B65D 85/72

[52] U.S. Cl. ..... 426/107; 426/113; 426/115; 426/119; 220/23.8

[58] Field of Search ..... 426/107, 234, 241, 243, 426/524, 113, 119, 115

[56] References Cited

U.S. PATENT DOCUMENTS

| | | | |
|---|---|---|---|
| 2,287,610 | 11/1939 | Guidry . | |
| 2,507,862 | 5/1950 | Mead | 426/524 |
| 2,591,261 | 5/1951 | Holahan . | |
| 2,600,566 | 6/1952 | Moffett, Jr. . | |
| 2,604,976 | 7/1952 | Sarg . | |
| 2,714,070 | 7/1955 | Welch . | |
| 3,107,027 | 10/1963 | Hong . | |
| 3,117,875 | 1/1964 | Burns et al. | 426/113 |
| 3,219,460 | 11/1965 | Brown . | |
| 3,220,856 | 11/1965 | Vischer | 426/113 |
| 3,230,864 | 1/1966 | Krajewski | 426/243 |
| 3,234,030 | 2/1966 | Knirim | 426/119 |
| 3,240,610 | 3/1966 | Cease . | |
| 3,244,537 | 4/1966 | Cease . | |
| 3,247,988 | 4/1966 | Cease . | |
| 3,271,169 | 9/1966 | Baker et al. | 426/114 |
| 3,305,126 | 2/1967 | Cease . | |
| 3,305,368 | 2/1967 | Bourelle . | |
| 3,326,363 | 6/1967 | Bennett et al. . | |
| 3,336,142 | 8/1967 | Lawson | 426/241 |
| 3,381,873 | 5/1968 | Hirota | 426/119 |
| 3,385,503 | 5/1968 | Stump . | |
| 3,393,076 | 7/1968 | Moyer et al. | 426/119 |
| 3,424,596 | 1/1969 | Sullivan | 426/113 |
| 3,505,490 | 4/1970 | Gorn | 426/241 |
| 3,547,660 | 12/1970 | Weisberg | 426/113 |
| 3,547,661 | 12/1970 | Stevenson . | |
| 3,615,713 | 10/1971 | Stevenson . | |
| 3,743,520 | 7/1973 | Croner . | |
| 3,779,372 | 12/1973 | de Lloret . | |
| 4,031,261 | 6/1977 | Durst | 426/234 |
| 4,055,670 | 10/1977 | Belmont | 426/119 |
| 4,112,833 | 9/1978 | Oda et al. . | |
| 4,133,896 | 1/1979 | Standing et al. . | |
| 4,166,208 | 8/1979 | Martel et al. . | |
| 4,214,515 | 7/1980 | Kubiatowicz | 426/243 |
| 4,228,945 | 10/1980 | Wysocki . | |
| 4,233,325 | 11/1980 | Slangen et al. . | |
| 4,285,490 | 8/1981 | Hanley . | |
| 4,286,136 | 8/1981 | Mason | 426/243 |
| 4,343,978 | 8/1982 | Kubiatowicz | 426/243 |
| 4,416,907 | 11/1983 | Watkins | 426/234 |
| 4,574,174 | 3/1986 | McGonigle . | |

FOREIGN PATENT DOCUMENTS

| | | | |
|---|---|---|---|
| 0200220 | 11/1986 | European Pat. Off. | 426/113 |
| 1110776 | 6/1965 | United Kingdom . | |
| 1451094 | 9/1976 | United Kingdom . | |

*Primary Examiner*—Steven Weinstein
*Attorney, Agent, or Firm*—R. Lewis Gable

[57] ABSTRACT

An assembly for packaging a frozen food is adapted to be exposed to microwave energy such that the frozen food is processed and, in particular, defrosted efficiently from its solid to its liquid state. The assembly includes a container normally disposed on the bottom, and a cover normally disposed on the top of the assembly and adapted to be releasably engaged with the container to form the assembly. When assembled, the cover and container support in a generally upright orientation the frozen food. The cover includes means for supporting only a top portion of the frozen food, while exposing the bottom portion of the frozen food directly to microwave energy.

8 Claims, 1 Drawing Sheet

FROZEN FOOD COVER/CONTAINER ASSEMBLY FOR RECONSTITUTING THE FROZEN FOOD

FIELD OF THE INVENTION

This invention relates to an apparatus and method of preparing food and, in particular, frozen food. More specifically, this invention relates to a cover/container assembly for receiving the frozen food such as soup and presenting the frozen food to microwave energy in a manner that the frozen food is defrosted from its frozen state to its liquid state and then raised to an elevated, serving temperature in an acceptably short period of time.

DESCRIPTION OF THE PRIOR ART

Microwave cooking has now become widely accepted for the preparation of foods in restaurants, domestic use and institutional use. The electromagnetic waves at microwave frequencies assigned by the Federal regulatory agencies are radiated within an enclosure from a source of energy such as a magnetron. The heating or cooking is accomplished by high-frequency oscillating movements of the molecules in the food being processed.

U.S. Pat. No. 4,233,325 of Slangan et al. is illustrative of the prior art in which a package is designed to be exposed to microwave energy. The Slangan et al. package includes a first container for receiving a food substance to be heated and a second container including a microwave shield for receiving a food substance to remain relatively unheated. Slangan et al. particularly discloses that the first container receives ice cream and a second container receives a refrigerated or frozen syrup. A shield is incorporated as a base of the second container and is made of a material that is substantially resistant to the passage of microwave energy, whereby when the entire package is disposed within a microwave oven, the microwave energy will serve to heat the frozen syrup, but will not penetrate into the first container to heat the ice cream. After the frozen syrup has been heated and defrosted, the second container is punctured, whereby the heated syrup is permitted to flow onto the ice cream.

U.S. Pat. No. 4,285,490 of Hanley discloses a microwave heating container in the form of a first or forming cup for receiving a food or drink in liquid form, and a second or serving cup having a base adapted to be disposed over the first cup so that its base encloses the open end thereof. As shown in FIG. 4 of the Hanley patent '490, a lid is adapted to be removably attached to the open end of the serving cup and is associated with the base of the first cup. As shown in FIG. 2, a liquid is disposed within the first cup prior to freezing and, thereafter, may be inverted as shown in FIG. 4. When it is desired to serve, the first cup is removed and a second liquid is disposed about the frozen liquid as shown in FIG. 1.

Though not related to microwave processing, heating or cooking, U.S. Pat. No. 2,591,261 of Holahan discloses a container as shown in his FIGS. 1 and 2, as comprising a cover which serves as a protecting cover and a serving tray, and a mold portion having a plurality of receptacles for receiving a liquid substance and for serving as a mold in a subsequent freezing operation. The Holahan patent '261 suggests that the cover has a plurality of studs for receiving one end of a like plurality of sticks. The other ends of the sticks are embedded within the frozen foods so that the frozen foods are supported upwardly from the cover.

The prior art demonstrates the efficacy of heating and/or cooking food with microwave energy. However, microwave energy, like other forms of heating, has not proven to be a particularly rapid means for defrosting a frozen food substance, i.e. to convert food from its frozen to its liquid or thawed state. This lack of efficiency is understood when it is noted that water, a constituent of many foods, has a heat of fusion of 144 BTU per pound thereof. In other words, a large quantity of heat is required to convert a pound of frozen water at 32° F. to liquid water at 32° F., i.e. 144 BTU per pound. On the other hand, a relatively small quantity of heat, i.e. 1 BTU, is required to heat a pound of water 1° F.

The prior art has suggested containers, typically cylindrical in configuration, for defrosting and thereafter heating frozen foods such as soup. Typically, the soup is introduced into the container, substantially filling the container before it is frozen. When ready to be served, the container with its frozen soup therein is disposed into a readily available microwave oven. Typically, the defrosting and heating process would require 800 watts of microwave energy, approximately six minutes to convert most but not all of the ten ounces of soup from its frozen to its liquid state. After a first defrosting step, the container is removed and the combination of liquid and frozen soup is stirred to break up the remaining frozen portion, before subjecting the container in a second defrosting step to microwave energy of the same level for five more minutes. At the end of the second step, all of the frozen soup has been converted to liquid and brought to a temperature in the order of 150°to 155° F.

Though such a frozen soup container might be acceptable for many applications, e.g., defrosting and heating a soup in a residential setting, such a container and method of defrosting and heating would be too slow and inefficient for applications in "fast food" restaurants and convenience stores. In a typical convenience store, a customer will purchase a food product and will employ a microwave oven provided by the store to heat and cook the purchased food item for immediate consumption. Existing containers as completely filled with frozen soup require in excess of ten minutes to prepare for serving. Market studies have shown that such a long defrosting process would not be appealing to a typical convenience store customer. Further, a convenience store owner would not appreciate such a container/food product in that it would unduly pre-occupy one of the stores microwave ovens and thus discourage the sale of other food products requiring microwave processing.

SUMMARY OF THE INVENTION

It is thus an object of this invention to provide a new and improved method of preparing and cover/container assembly for a frozen food such as a soup, whereby the frozen food may be quickly converted from its frozen to its liquid state and its temperature elevated to a serving temperature.

It is a more particular object of this invention to provide a cover/container assembly for receiving a frozen food such as soup that is suitable for processing in a microwave oven, such that the soup may be converted from its frozen state to its liquid state and raised to a serving temperature in the order of 170° F. within a time period not to exceed 2½ minutes and preferably less.

It is a still further object of this invention to increase the efficiency of the defrosting of a frozen food and, in particular, for providing a new and improved frozen food whose configuration is adapted to maximize its exposed surface per unit volume or weight of the frozen food.

In accordance with these and other objects of this invention, there is disclosed an assembly for packaging a frozen food and adapted to be exposed to microwave energy such that the frozen food is processed and, in particular, defrosted efficiently from its solid to its liquid state. The assembly includes a container normally disposed on the bottom, and a cover normally disposed on the top of the assembly and adapted to be releasably engaged with the container to form the assembly. When assembled, the cover and container support in a generally upright orientation the frozen food The cover includes means for supporting only a top portion of the frozen food, while exposing a bottom portion of the frozen food directly to microwave energy.

In an illustrative embodiment of this assembly, the supporting means of the cover takes the form of at least one pocket whose interior surface has a configuration similar to that of the top portion of the frozen food, whereby the frozen food is supported for a significant portion of the defrosting process by the assembled container and cover. Further, the cover may illustratively have a plurality of such pockets to receive a plurality of corresponding-like components or slugs of the frozen food. The aforementioned pockets hold the plurality of slugs so that at least at the beginning of the defrosting process, none of the slugs as supported by the assembly directly contact or abut each other.

In a further aspect of this invention, the frozen food is configured to maximize the ratio of its exposed surface per unit weight or volume thereof. By so increasing the exposed exterior surface of the frozen food, the efficiency of the microwave energy to defrost the frozen food is increased. Illustratively, the frozen food may be divided into plural components or slugs thereof, whereby the total exposed surface of the frozen food is increased. Further, the configuration of the food slug may be such that the ratio of its axial height to an average cross-sectional circumference is greater than 0.7.

In a further aspect of this invention, the cross-sectional area of the top portion of the food slug is less than the cross-sectional area of its bottom portion. By so configuring the food slug, the microwave energy is permitted to completely penetrate the top portion of the frozen food slug, whereby it is first defrosted. By first defrosting the top portion and by making the bottom portion larger, the slug is held in an upright portion for a greater portion of the defrosting process.

In a still further aspect of this invention, there is disclosed a method of defrosting a frozen food including the steps of exposing the frozen food to microwave energy. In particular, the frozen food is supported in an upright position and microwave energy is directed onto the exterior surface thereof, as successive layers are defrosted into liquid, the defrosted liquid is permitted to drip or fall away and new successive layers are exposed to the microwave energy. The liquid food drips away and is collected in the container. After being defrosted, the liquid food is continued to be exposed to microwave energy, whereby it is heated to the desired serving temperature.

In a still further aspect of this invention, there is disclosed a method of packaging and freezing a food, wherein the food is frozen into a slug thereof and, thereafter, inserted into an assembly as describe above, whereby the top portion of the slug is supported by the cover supporting means and the bottom portion of the slug is supported by the container.

BRIEF DESCRIPTION OF THE DRAWINGS

These and other objects and advantages of the present invention will become apparent by referring to the following detailed description, and accompanying drawings, in which.

DESCRIPTION OF THE PREFERRED EMBODIMENT

Figure 1:
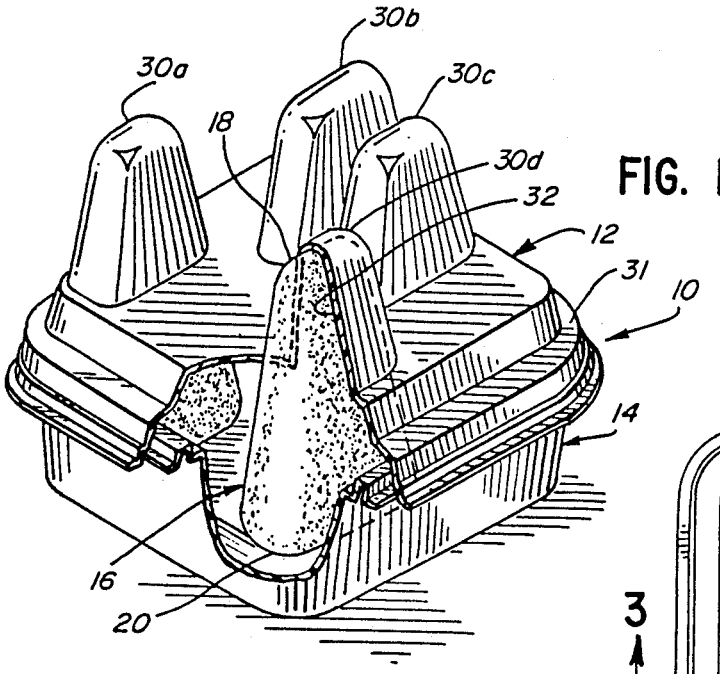
FIG. 1 is a perspective view of a cover/container assembly adapted for processing by microwave energy in accordance with the teachings of this invention.
Figure 3:
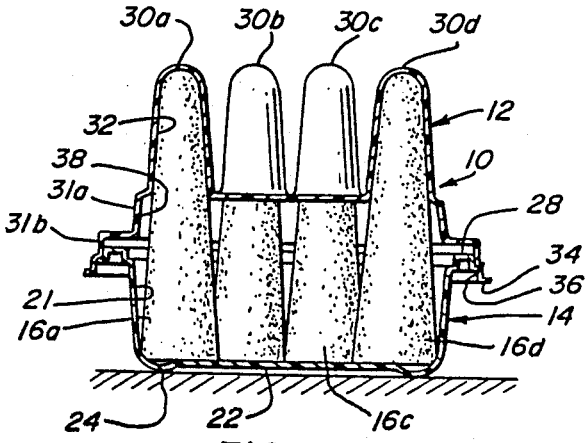
FIG. 3 is a cross-sectional view of the cover/container assembly as taken through line 3—3 as shown in FIG. 2.

With reference to the drawings and, in particular, to FIG. 1, there is shown a perspective view of a cover/-container assembly 10 in accordance with this invention. The cover/container assembly 10 is adapted to receive a frozen food such as soup and to process the frozen food by subjecting same to microwave energy, whereby the frozen food is converted from its frozen or solid state to a liquid state and, subsequently, its temperature raised to a serving temperature in the order of 170° F. The cover/container assembly 10 includes a cover 12 and a bottom or container 14 adapted to be mated with each other as shown in FIGS. 1 and 3. The assembly lo and in particular the cover 12 is adapted for receiving the frozen food. As illustrated in FIG. 1, the food is formed into a plurality, e.g. 4, of units or slugs 16 of the frozen soup, which are supported in a generally upright or vertical orientation by the cover 12, as shown in FIGS. 1 and 3.

The slug 16 of the frozen soup is pre-formed by disposing any of a variety of liquid food substances into a mold. A mold such as that made by Tupperware under their Model No. T-40 for forming quiescently frozen confections has been employed with a variety of soups. After the liquid food is introduced into such molds, the molds are in turn subjected to temperatures of about 1° F. for a period of time sufficient to freeze the food into the plurality of slugs 16. After freezing, the slugs 16 are removed from their molds and inserted into the assembly 10 as shown in FIGS. 1 and 3, noting that portions of the cover 12 and container 14 have been broken away to show a typical storage position of the slugs 16. As illustrated in FIGS. 1 and 3, the slug 16 is of a slender, generally conical configuration, wherein its base 20 has a larger cross-sectional area than its top 18.

Figure 4:
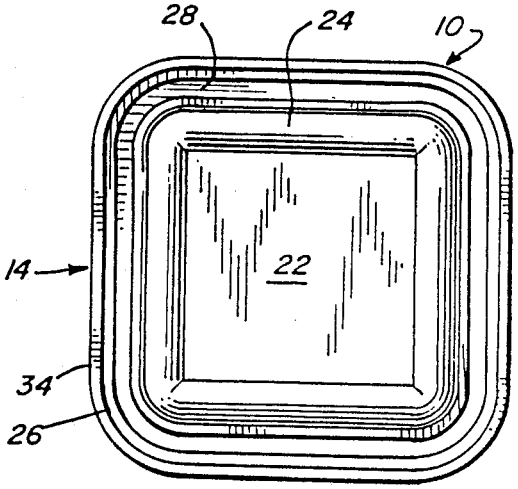
FIGS. 4 and 5 are respectively a plan view and a sectional view of the cover of the cover/container assembly as shown in FIG. 1.
Figure 5:
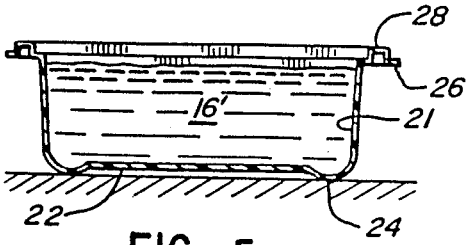

Referring now to FIGS. 3, 4 and 5, there is shown the bottom or container 14 of the cover/container assembly 10. As will become apparent, the container 14 supports the base of the frozen slugs 16 and, after reconstitution, functions as a serving dish for the defrosted liquid soup 16′ as will be collected therein. The container 14 includes a bottom 22 and a raised portion 24 disposed in a rectangular configuration, as shown in FIG. 4, about the lowermost portion of the container 14. The raised portion 24 displaces the bottom 22 of the container 14 from any surface upon which the container 14 may rest, whereby heat loss from the heated soup will be minimized and the supporting surface will be protected from the heat. Further, the container 14 includes a lip 26 disposed about an open mouth thereof and at substantially right angles with each of a plurality of upright sidewalls 21 of the container 14. The lip 26 includes a retaining projection 28 disposed continuously thereabout for mating, as will be explained, with the cover 12, whereby the container 14 and the cover 12 are retained in an assembled relation as shown in FIGS. 1 and 3.

Figure 2:
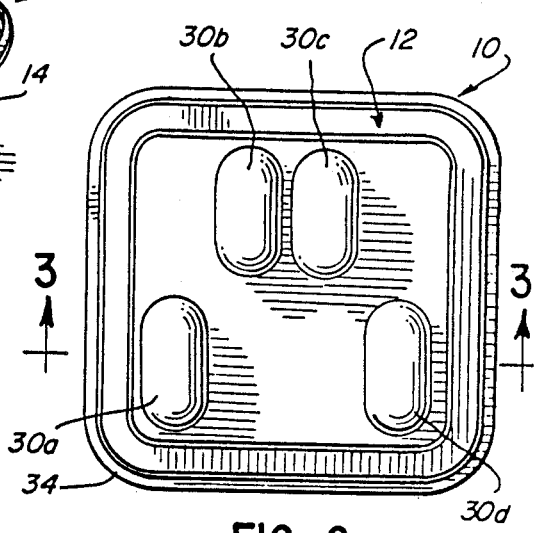
FIG. 2 is a plan view of the cover of the assembly as shown in FIG. 1.

Referring now to FIGS. 1, 2 and 3, the cover 12 is more fully shown. In particular, the cover 12 includes a plurality of pockets 30*a*, 30*b*, 30*c* and 30*d* for receiving and supporting the top most portions of the corresponding plurality of the slugs 16. As particularly illustrated in FIG. 3, each of the pockets 30 extends vertically upward from a base portion 31 thereof. The base portion 31 defines an open mouth, about which is integrally formed a lip 34 extending outwardly therefrom. A recessed portion 36 is formed, as best shown in FIG. 3, and extends about the mouth and is of a configuration and a dimension to receive the retaining projection 28 of the container 14, whereby the cover 12 and the retainer 14 are releasably held in their assembled relation. After the slugs 16 have been reconstituted, the user may merely grasp the lip 34 and lift upward, whereby the cover 12 is readily separated from the container 14.

As best shown in FIGS. 1 and 3, the pockets 30 are configured to receive and to support the top most portion of the food slugs 16. Each of the pockets 30 has an interior surface generally following the configuration of the upper portion of the slugs 16. In an illustrative embodiment of this invention, the slugs 16 are configured in the shape of a well known frozen confection; therefore, the inner surface 32 of each of the pockets 30 is likewise configured.

As shown in FIGS. 1 and 2, the pockets 30*a*, 30*b*, 30*c* and 30*d* are arranged in first and second rows, with pockets 30*a* and 30*d* being disposed in a first or lower row and spaced relatively far apart, and pockets 30*b* and 30*c* disposed in a second or upper row and spaced relatively close together. In a further embodiment of this invention, as adapted to receive and support five slugs 16, the cover 12 could be made with five pockets 30, four of which would be disposed in the corners of and the fifth pocket 30 disposed in the center of the cover 12. These configurations of pockets 30 ensure that the slugs 16 are sufficiently separated from each other so that no part thereof and, in particular, their bottoms 20 do not touch. It is important that the pockets 30 of the cover 12 support the slugs 16 to permit during reconstitution or defrosting the microwave energy to impinge on all exterior surfaces of each slug 16. When the cover/container assembly 10 is inserted within a microwave oven during reconstitution, the microwaves penetrate freely the cover 12 and the container 14, which support the slugs 16 so that none of their surfaces will abut each other and possibly restrict the flow of microwaves to all of the exposed surfaces of the slugs 16. It is understood that during reconstitution, that the slugs 20 will melt and tend to "slump" into the container 14. It is important that even during these stages of the slug reconstitution, that their exposed surfaces do not abut. Otherwise, frozen masses of the slugs 16 will come together and will be difficult to defrost.

It is a further significant aspect of this invention, that the slugs 16 be supported by their respective pockets 30 in a fashion that permits successive outer layers of each slug 16 to defrost and to fall or drip away into the container 14 disposed there beneath to receive the melt from the slugs 16. In order to accomplish this object, the base 31 of the cover 12 has an interior surface 38, as best shown in FIG. 3, that is displaced away from the exterior surfaces of the slugs 16. In the prior art as described above, a liquid food such as soup is poured into a container and is frozen, whereby the peripheral surface of the frozen food abuts directly the interior surface of its container. Thus, the food even after it has been converted from its frozen to liquid state, is held in contact with the remaining frozen mass of soup. The retained liquid attenuates the microwaves as they attempt to penetrate therethrough and to impinge upon the remaining frozen food. Thus, the process of reconstitution or defrosting is significantly slowed in that the microwaves are attenuated by the defrosted liquid as they attempt to penetrate into and to continue the defrosting of the remaining frozen food. By displacing the interior surface 38 of the cover 12 from the exterior surfaces of the slugs 16, successive exterior layers of the slugs 16 are directly exposed to the microwave energy, are defrosted and are permitted freely to drip away and to collect within the container 14. As one layer is melted away, a new exterior surface of the slug 16 is exposed directly to the microwave energy to be defrosted. This displacement of the interior surface of the cover 12 remotely from the exterior surface of the slugs 16 significantly increases the efficiency of the reconstituting process.

It is also important to support the slugs 16 in an upright orientation during as much of the reconstituting process as possible. As the slugs 16 are exposed to microwaves and outer exterior portions thereof are defrosted and melt away, their height will shrink to a point such that they will no longer be supported within their corresponding pockets 30; at that time, a slug 16 will slump or topple into its container 14. After a slug 16 has slumped, there is no means of preventing adjacent slugs 16 from abutting each other and of thus preventing microwave energy from impinging directly thereon. In addition, the melted soup will tend to cover the slumped slugs 16, thereby attentuating the effect of the microwaves passing therethrough to the still frozen cores of a slumped slug 16. As best illustrated in FIGS. 1 and 3, the bottom 22 of the container 14 supports the bottoms 20 of each of the slugs 16 and the interior surfaces 32 of the pockets 30 closely fit and abut against the exterior surfaces of the top most portions of the slugs 16, holding them in an upright orientation, whereby the reconstitution process continues efficiently. In the illustrative embodiment as shown in FIGS. 1 and 3, the interior surface 32 of a pocket 30 supports directly an upper third of a slug 16 as measured along a vertical axis thereof. It is contemplated, that such surfaces 32 could be dimensioned larger to support an upper half of the slug 16, whereby the slugs 16 would be supported by their pockets 30 for an even longer portion of the reconstitution process. In such an embodiment, the height of each of the pockets 30 would be extended down to that portion 31*b* of the base 31 of the cover 12.

The cover 12 and the container 14 must be made of a material, which is transparent to microwave energy. In an illustrative embodiment of this invention, the container 14 may be made of a visibly opaque material such as polyethylene of an illustrative thickness of 20 mils, whereas the cover 12 may be made of a visibly transparent material such as polypropylene or other suitable thermoplastic material, whereby a food purchaser may observe the frozen food contained within the assembly 10.

An illustrative method of reconstituting or defrosting the slugs 16 in the cover/container assembly 10 as shown in the drawings, will now be described. Such a cover/container assembly 10 was inserted within a microwave oven such as that model NE-1670 as manufactured by Panasonic with an energy input of 1600 watts. In this embodiment, four, 2 ounce slugs 16 were made up of chili, cream of broccoli or beef vegetable soup. As noted above, it is an object of this invention to significantly reduce the defrosting time so that frozen foods may be readily marketed in convenience stores, wherein it would be necessary to complete the defrosting process in a relatively short period of time, e.g. 2½ minutes. When exposed to 1600 watts of microwave energy, the slugs 16 were completely defrosted within 85 seconds, i.e. all of the frozen food was converted to liquid at 32° F. The reconstituting process continued for a further 45 seconds, during which the temperature of the soup was raised from 32° F. to a serving temperature of approximately 170° F. The container and method of this invention were successful to defrost relatively dense foods such as chili and creamed soups, which are most difficult to defrost.

In a significant aspect of this invention, it is important to maximize the exterior surface area of the frozen food per unit weight or volume thereof, whereby the exposure of the frozen food directly to the microwave energy is likewise maximized. As described above, the frozen food is formed or frozen into the plurality of like component slugs 16, thus increasing the exposed surface area thereof. For example, a 10 ounce food container of a cylindrically truncated configuration presents an exterior surface area of 34.4 $in^2$, thus yielding surface area to volume and weight ratios respectively of 1.63 $in^2/in^3$ and 2.92 $in^2$/ounce. By comparison, if 10 ounces of soup are divided into five slugs 16 of the configuration shown in the accompanying drawings, the exposed surface area of the frozen food increased to 85.6 $in^2$ and these ratios to 24.75 and 42.8.

Further, the configuration of each of the slugs 16 may be designed to maximize its exposed surface area. As best shown in FIGS. 1 and 3, the configuration of the slugs 16 is particularly adapted to this method of reconstituting, whereby the time required for defrosting is reduced. In particular, each slug 16 is configured to have a ratio of its axial height to an average cross-sectional circumferential dimension that is relatively high in the order of 0.7 or better. In addition, the cross-sectional area at the bottom 20 is greater than the cross-sectional area at its top 18. By so adjusting the cross-sectional areas, the bottom 20 of the slug functions as a supporting base, whereby the slug 16 is maintained in its upright orientation for an extended portion of the defrosting process. Further, reducing the cross-sectional area of the top 18 ensures that microwave energy readily penetrates the top most portions of a slug 16, whereby the top of the slug 16 tends to defrost first, thereby further ensuring the stability of that slug 16 during its defrosting process.

Thus, there has been shown and described a new and improved cover/container assembly for defrosting a frozen food, as well as a new and improved configuration of such food and method employing this assembly for reconstituting and serving the food. In particular, there has been taught a new method and apparatus for supporting the frozen food during its defrosting, whereby its exterior surface is continuously exposed directly to microwave energy, and successive layers of the frozen food are defrosted, readily removed and collected for subsequent heating and serving. As one layer of the frozen food is defrosted and removed, a new frozen layer is directly exposed directly to the microwave energy without any intervening mass of the defrosted food being present to attenuate the microwave energy. As a result, the defrosting time for eight ounces of a frozen food, e.g. soup, have been significantly decreased from a time of in excess of 10 minutes to approximately 2 minutes. In addition, the serving temperature has been increased from 150° to 170° F.

In considering this invention, it should be remembered that the present disclosure is illustrative only and the scope of the invention should be determined by the appended claims.

I claim:

1. A package for frozen liquid food adapted to undergo a reconstituting process including exposure to microwave energy, said package comprising:

(a) a mass of said frozen liquid solidified food having a top portion, a bottom portion and an intermediate peripheral surface, said frozen liquid food requiring thawing to a liquid state for consumption;

(b) a container adapted in normal use to be the bottom part of said package, said container having a first open mouth; and (c) a cover disposed as the top part of said package, said cover having a second open mouth releasably engaging said first open mouth of said package and a pocket in said cover having an interior surface of a configuration corresponding to the shape of said top portion of said frozen liquid food, said bottom container and said top cover being assembled to form said package with said frozen liquid food contained therein and supported at said top portion of said frozen liquid food by said pocket and said bottom portion of said frozen liquid food resting on said bottom container, said frozen liquid food being supported between said bottom container and said top cover in an upright manner such that most of said peripheral surface of said frozen liquid food is free of contact with said package and said pocket extending down along the length of said frozen liquid food a distance sufficient to retain said liquid food upright and supported between said assembled bottom container and said top cover during at least a part of the thawing.

2. The package as claimed in claim 1, wherein said solidified mass has a predetermined height, and an average circumferential dimension taken at a cross-section thereof, the ratio of said height to said dimension exceeding 0.7.

3. The package as claimed in claim 2, wherein the area of a cross-section taken through said bottom portion is greater than the area of a cross-section taken through said top portion.

4. The package as claimed in claim 1, wherein said top portion of said solidified mass is of a particular configuration, and said supporting means includes a pocket having an interior surface of a configuration corresponding to said particular configuration.

5. The package as claimed in claim 4, wherein the solidified mass is divided into a plurality of slugs, and said supporting means comprises a plurality of said pockets, wherein said top portion of each of said plurality of slugs is supported in a corresponding one of said plurality of pockets.

6. The package as claimed in said claim 5, wherein said plurality of pockets supports said plurality of said slugs respectively in a manner that none of said solidified slugs directly abut each other while supported by said assembled top cover and said bottom container.

7. The package as claimed in claim 1, wherein said bottom container is of sufficient size to retain the liquid resulting from subjecting said solidified slugs to thawing.

8. The package as claimed in claim 1, wherein said reconstituting process includes thawing said solidified mass into a liquid and said bottom container is of a size sufficiently larger than that of said solidified mass to collect the liquid resulting from thawing said solidified mass and to hold the resulting liquid remote from said free peripheral surface of said solidified mass.

* * * * *